United States Patent [19]

Symington

[11] Patent Number: 4,637,215

[45] Date of Patent: Jan. 20, 1987

[54] REGENERATOR WITH SPRAY COOLER

[75] Inventor: John Symington, Rockford, Ill.

[73] Assignee: Sundstrand Corporation, Rockford, Ill.

[21] Appl. No.: 768,735

[22] Filed: Aug. 23, 1985

[51] Int. Cl.[4] ..... F01K 7/30

[52] U.S. Cl. ..... 60/688; 60/691; 60/654

[58] Field of Search ..... 60/688, 689, 653, 654, 60/690, 691, 692

[56] References Cited

U.S. PATENT DOCUMENTS

| | | | |
|---|---|---|---|
| 277,075 | 5/1883 | Stillson . | |
| 782,222 | 2/1905 | Cuthbert et al. . | |
| 2,064,825 | 12/1936 | Flanders | 60/688 |
| 2,956,784 | 10/1960 | Parkinson . | |
| 3,830,063 | 8/1974 | Morgan | 60/692 X |
| 4,009,576 | 3/1977 | Doerner et al. | 60/670 X |

*Primary Examiner*—Allen M. Ostrager

*Attorney, Agent, or Firm*—Wood, Dalton, Phillips, Mason & Rowe

[57] ABSTRACT

Component size difficulties in a closed-cycle steam turbine system are eliminated by disposing an annular regenerator about a turbine wheel and providing spray nozzles at the outlet of the regenerator for eliminating superheat in the exhaust steam passing through the regenerator prior to its condensation in a condenser.

7 Claims, 5 Drawing Figures

FIG. 3
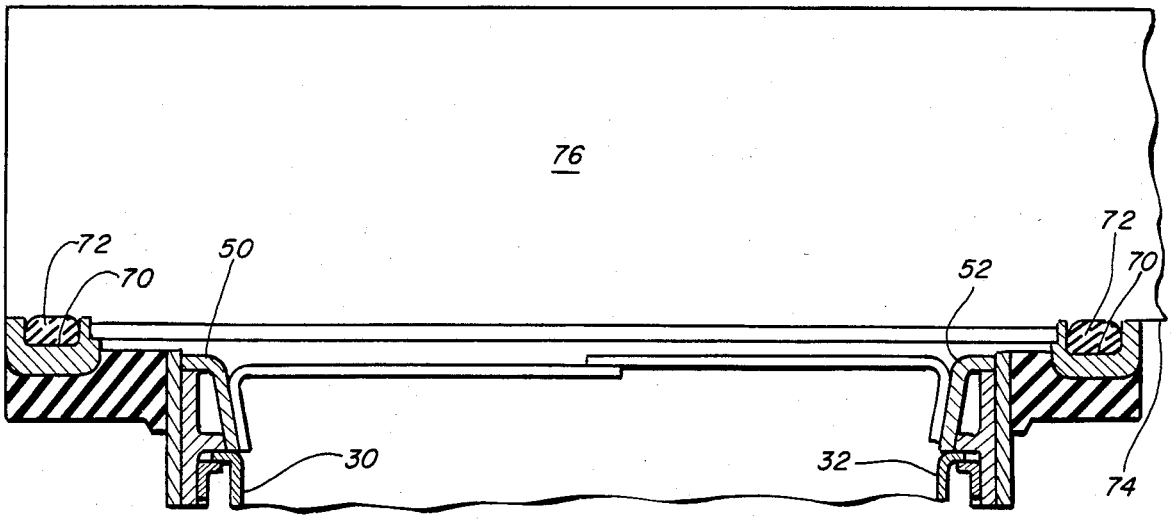
FIG. 5
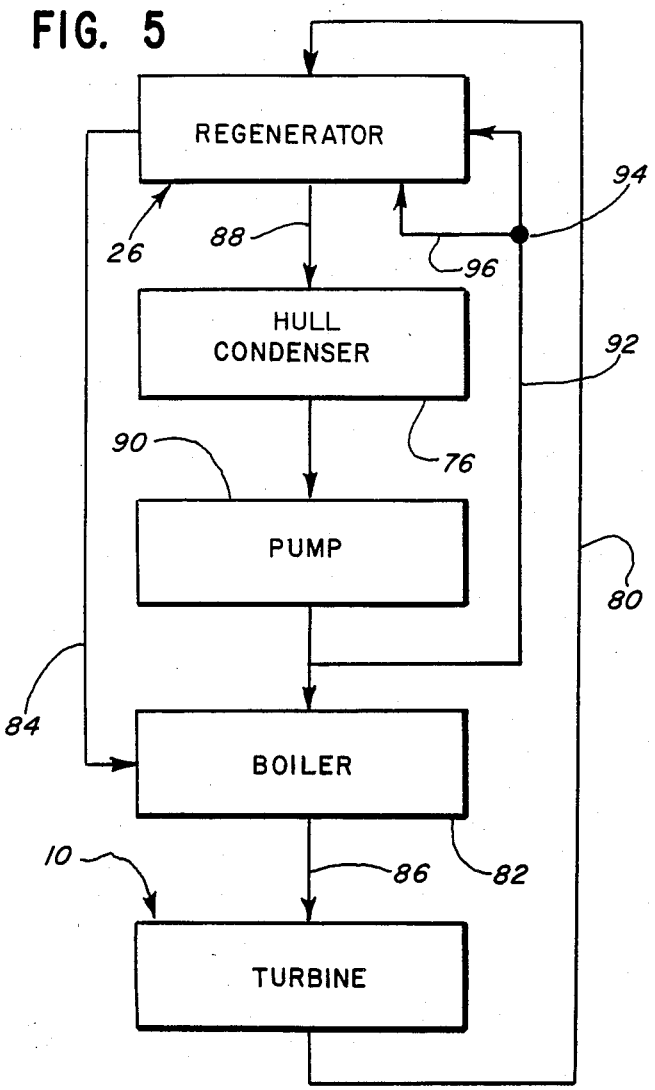
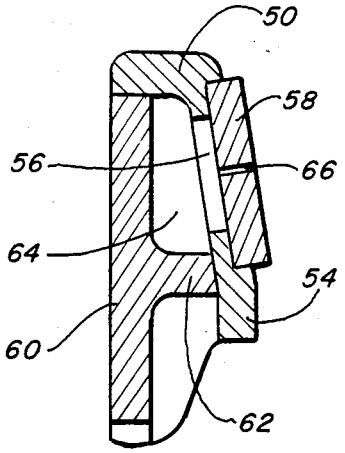
FIG. 4

REGENERATOR WITH SPRAY COOLER

FIELD OF THE INVENTION

This invention relates to steam turbine systems, and more particularly, to a spray cooled regenerator intended for use in such systems.

BACKGROUND OF THE INVENTION

Various means have been utilized to provide propulsion for torpedoes. Desirably, such systems should be quiet in operation to prevent or minimize the possibility of premature detection.

Further, the system should not be depth-sensitive, that is, should be capable of operating in a single, specified fashion whether located just below the surface or substantially below the surface.

Many systems that have been proposed, particularly those utilizing steam turbines, have not met the above criteria. Typically, such systems are open cycle systems where spent or exhaust steam is vented from the torpedo during its operation. Such venting not only increases the noise level of operation, but renders the torpedo sensitive to the depth at which it is running since the back pressure resisting venting will vary proportionally to depth.

To avoid these difficulties, it is proposed to provide a closed cycle steam turbine system particularly suited as a source of propulsion for torpedoes. As implied by the term "closed cycle", the working fluid, namely water, after it exhausts from the turbine as steam, is condensed and subsequently evaporated to form additional steam for driving the turbine wheel. As a consequence, the working fluid flows throughout the closed cycle, eliminating any need for venting the same, in turn, eliminating the source of noise associated with venting and sensitivity to depth.

The difficulty with such a system is that it necessarily requires more components than an open cycle system, including at a bare minimum, a condenser for condensing the exhaust steam from the turbine wheel and a pump for delivering the condensate to the boiler.

In addition, a regenerator is desirably incorporated in the system to maximize its efficiency.

To incorporate such additional components in a torpedo without unduly enlarging its size over and above that of an otherwise identical open cycle torpedo is a considerable task.

The present invention is directed to accomplishing that task.

SUMMARY OF THE INVENTION

It is the principal object of the invention to provide a new and improved steam turbine with a regenerator. More specifically, it is an object of the invention to provide such a turbine and regenerator which is extremely compact and which may interact with a condenser in such a way as to be ideally suited for utilization in a close-cycle steam turbine system such as may be employed in a torpedo.

An exemplary embodiment of the invention achieves the foregoing objects in a steam turbine comprising a rotatable turbine wheel. An annular heat exchanger is disposed just radially outwardly of the wheel and has a first fluid flow path including an annular outlet and an inlet in fluid communication with the turbine wheel to receive exhaust steam therefrom. The annular heat exchanger further has a second fluid flow path in heat exchange relation with the first path, the second path being adapted to receive make-up water for the steam turbine. Means are provided for generating an annular spray across the first flow path at the outlet thereof.

As a consequence of this construction, any superheat remaining in exhaust steam from the turbine wheel after it has passed through the first flow path is dissipated by the cooling spray at the outlet of the first flow path before the steam passes through a condenser which may be connected to such outlet. This, in turn, reduces the size of the condenser required to effect condensation of the working fluid prior to re-evaporation of the same. At the same time, the disposition of the regenerator annularly about the turbine wheel provides for considerable compactness, particularly in the axial direction.

According to the invention, the inlet for the first flow path is on the radially inner side of the heat exchanger and the outlet is on the radially outer side. Means are provided to define a condenser radially outwardly of the outlet and in fluid communication therewith. In the case where the system is employed in the torpedo, the condenser will be a so-called hull condenser which relies on the relatively cool temperature of the water in which the torpedo is operating, to create a temperature differential across the hull of the torpedo to effect condensation.

The invention contemplates, as alluded to previously, that the spray generating means be at the interface of the outlet and the condenser.

According to a preferred embodiment of the invention, the first flow path of the heat exchanger is radially directed and the turbine wheel is an axial flow turbine wheel. The inlet to the first flow path includes a flow director for receiving axially flowing exhaust steam from the turbine wheel and for redirecting the exhaust steam radially to the first flow path.

The invention contemplates that the first flow path be defined by axially spaced, generally radially directed walls, each terminating in an annular conduit. The spray generating means comprise nozzles in the conduits, each nozzle being directed at the opposite conduit to thereby create an annular spray pattern across the entirety of the outlet.

In a preferred embodiment, the radially outwardly opening grooves are located on the walls adjacent the conduits and seals are disposed in the grooves. The seals are adapted to seal the outlet to a hull condenser in a closed cycle torpedo or the like.

The invention also contemplates use in a closed cycle steam turbine system including a turbine and heat exchanger with spray cooling as mentioned above, and further including a condenser connected to the outlet along with a boiler interposed between the condenser and the turbine wheel. A pump is provided for pumping water from the condenser to both the boiler via the heat exchanger and to the spray generating means.

Other objects and advantages will become apparent from the following specifications taken in connection with the accompanying drawings.

DESCRIPTION OF THE DRAWINGS

FIG. 3 is an enlarged, fragmentary sectional view of the interface of the heat exchanger and a condenser;

FIG. 4 is a further enlarged, fragmentary sectional view showing a typical nozzle configuration; and FIG. 5 is a block diagram illustrating the closed-cycle steam turbine system.

DESCRIPTION OF THE PREFERRED EMBODIMENT

Figure 1:
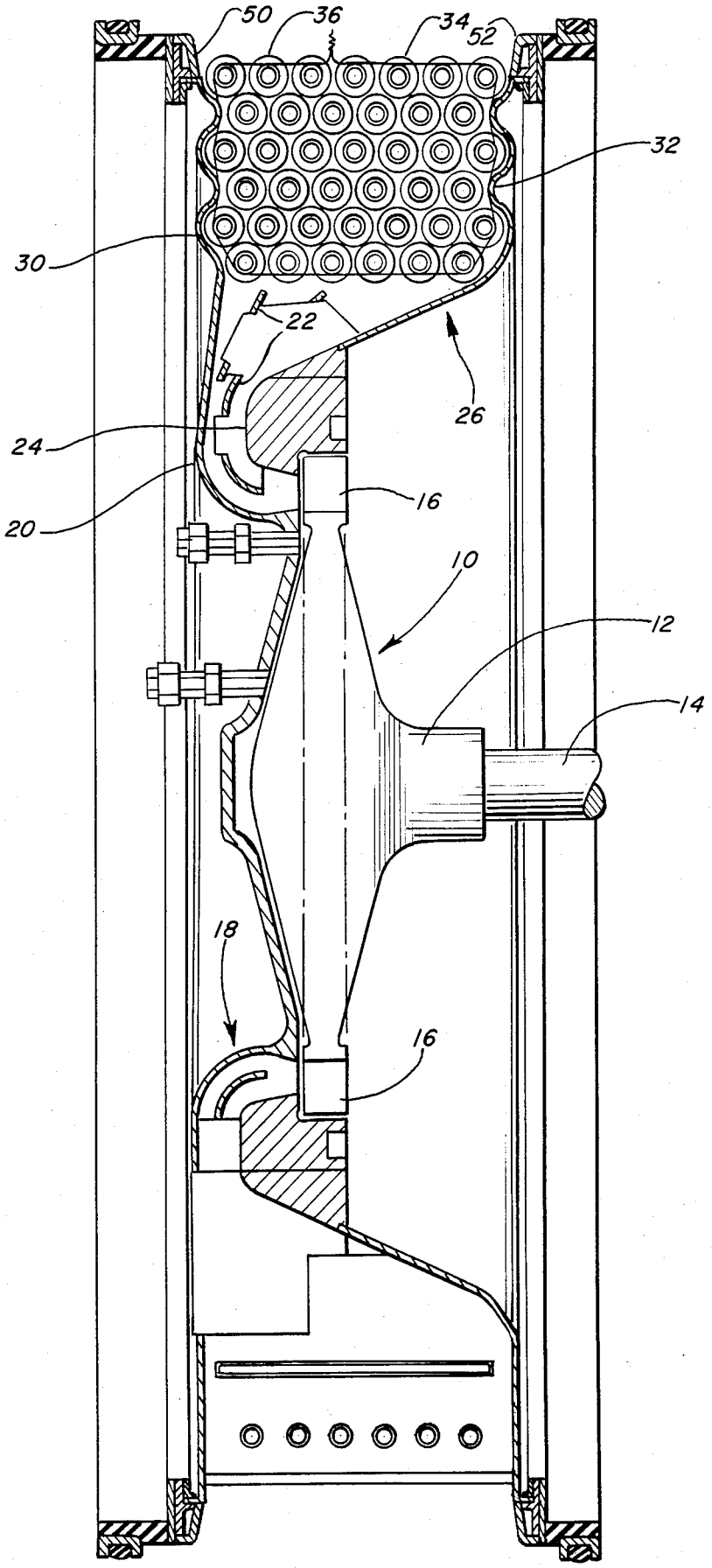
FIG. 1 is a sectional view of a turbine wheel and heat exchanger assembly made according to the invention.

An exemplary embodiment of a turbine and regenerator made according to the invention is illustrated in the drawings and with reference to FIG. 1, is seen to include a turbine wheel, generally designated 10, have a hub 12 mounted on a shaft 14 suitably journalled by bearings (not shown). The shaft 14 serves as the output for the turbine wheel 10.

At its radially outer periphery, the turbine wheel 10 includes a series of blades 16 defining an axial flow turbine, that is, one where the working fluid flows primarily in the axial direction parallel to the shaft 14 as opposed to the radial direction transverse to the shaft 14.

Suitable nozzles of any conventional construction (not shown) are utilized for directing steam at the blades 16 to rotate the wheel 10. Such nozzles would, of course, be located on the right-hand side of the blades 16 as viewed in FIG. 1. On the left-hand side of the blades 16 is a flow director, generally designated 18 which, by means of a curved wall 20, one or more curved baffles 22, and a further curved wall 24 serves to direct the exhaust steam from the turbine wheel 10, after it has flowed therethrough in the axial direction, in the radial direction.

Radially outwardly of the perimeter of the turbine wheel 16 is a heat exchanger, generally designated 26, which serves as a regenerator. The heat exchanger 26 generally surrounds the entirety of the periphery of the turbine wheel 10 save for an approximately 60 degree gap, shown generally at 28 in FIG. 2, which may be employed for routing fluid lines, electrical control systems, etc., from one side of the turbine wheel 10 to the other when the apparatus is employed in a confined space, as for example, a torpedo.

Figure 2:
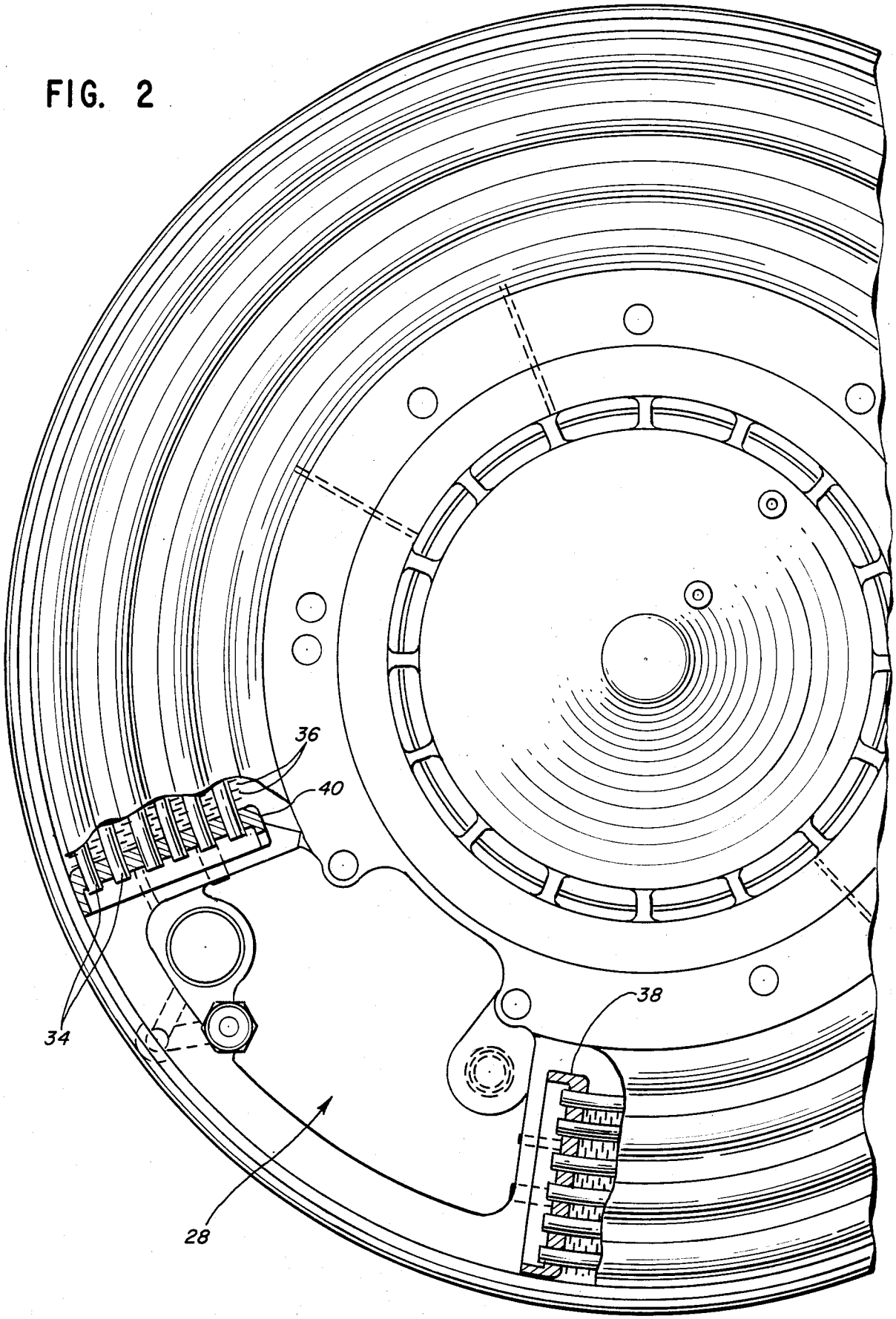
FIG. 2 is an elevational view of the turbine wheel and heat exchanger assembly with parts broken away for clarity.

As seen in FIGS. 1 and 2, the heat exchanger is made up of a radially outwardly extending continuation 30 of the wall 20 and an axially spaced, generally radially outwardly directed wall 32 mounted on the wall 24 in any suitable fashion. The walls 30 and 32 define a first flow path through the heat exchanger 26 which is generally radially directed about the entire periphery of the turbine wheel 10 save for the gap 28. The inlet to such first flow path is radially inwardly on the heat exchanger 28 and is defined by the portions of the walls 20 and 24 adjacent the plate 16. The outlet from the heat exchanger 26 is radially outwardly and is defined generally by the radially outer perimeters of the walls 30 and 32 as will be described in greater detail hereinafter.

Within the space between the walls 30 and 32 are six rows of ring-shaped tubes 34. Each of the tubes 34, for enhanced heat exchange, is provided with a series of ring fins 36.

As best seen in FIG. 2, opposite ends of each of the tubes 32 terminate in headers 38 and 40 flanking the space 28. Though not shown in FIG. 2, it is preferred that one of the headers 38 and 40 be closed by a baffle or cap including an outlet whereby two rows of the tubes 34 are placed in fluid communication within adjacent two rows of the tubes 34 and the remaining two rows connected to the outlet. A similar baffle cap is utilized in connection with the other header 38 and 40 to provide an inlet as well as to connect sets of two rows of the tubes 34 in series to define a second flow path within heat exchanger 26. The second flow path having such a connection will be a triple pass flow path and is adapted to be provided with feed water prior to evaporation thereof in a boiler downstream in the system before the evaporated water is provided to the turbine wheel 10 to drive the same.

Thus, the heat of the exhaust steam from the turbine wheel flowing through the first path will brought into good heat exchange relation with relatively cool make-up water flowing within the tubes 34 to elevate the temperature of the same. Waste heat is then recaptured to maximize system efficiency and the size of the boiler utilized to evaporate the feed water may be commensurately reduced.

The radially outer periphery of each of the walls 30 and 32 terminates in an annular conduit 50 and 52 respectively. The conduits 50 and 52 are mirror images of each other so that only the conduit 50 will be described. An enlarged illustration of the same is illustrated in FIG. 4 and it is seen to include a generally ring-shaped plate 54 having an inverted L-shaped cross-section. At periodic intervals around the length of the plate 54, apertures 56 are disposed therein and spray nozzles 58 are secured to the plate 54 over such apertures. A second ring-shaped plate 60 having an annular flange 62 is suitably secured to the plate 54 as by brazing (not shown) in such a way as to define an annular space 64 at the interface of the plates 62 and 54 which acts as the conduit 50. As can be appreciated from FIG. 4, the space 64 is in fluid communication with the apertures 56, and thus the nozzles 58. Each nozzle 58 has a flat opening 66 therein which acts as the nozzle orifice. Preferably, the orifice 66 is configured to provide a flat spray which diverges about 30 degrees to each side of the center line of the orifice 66 to provide a fan-shaped spray extending over an arc of approximately 60 degrees.

The nozzles 58 on each of the plates 54 may then be angularly spaced from each other by about 60 degrees with the nozzles 58 associated with the conduit 50 being staggered approximately 30 degrees from the nozzles associated with the conduit 58. As a consequence of this, a ring-like annular spray covering the entirety of the outlet of the first flow path through the heat exchanger 58 is provided.

FIG. 3 also illustrates the provision of radially outwardly opening grooves 70 adjacent the conduits 50 and 52. The grooves 70 are adapted to receive seals such as O-rings 72 which in turn are adapted to seal against the radially inner wall, shown schematically at 74, of a hull condenser shown schematically at 76, when the apparatus is employed as part of a closed cycle torpedo. The hull condenser 76 is thus placed in fluid communication with the heat exchanger 26 with the spray nozzles 58 being disposed at the interface of the two.

The apparatus may be employed in a system such as that shown in block form in FIG. 5. In this instance, the heat exchanger 26 acts as a regenerator receiving exhaust steam from the turbine wheel 10 as indicated by an arrow 80. Feed water for the system flows through the tubes 34 to be heated by the exhaust steam and the same is then fed to a boiler 82 as shown by an arrow 84. The feed water is evaporated in the boiler 82 and fed, as shown by an arrow 86, to the turbine wheel 10 to drive the same.

The exhaust steam passing through the regenerator to heat the feed water is directed to the hull condenser 76 as shown by an arrow 88 where it is condensed and then pumped by a pump 90 to the tubes 34 in the regenerator 26 as shown by an arrow 92. At a junction 94, part of the stream from the pump 90 is split and directed to the conduits 50 and 52 as indicated by an arrow 96. As alluded to previously, the spraying of water across the outlet of the heat exchanger 26 removes all superheat from the emerging exhaust steam stream allowing the size of the hull condenser to be minimized.

At the same time, the provision of the regenerator in the system, minimizes the size of the boiler 82 and the configuration of the regenerator about the turbine wheel 10 provides for an extreme degree of axial compactness.

Thus, the apparatus, while it may be used in any application involving a steam turbine and a regenerator, is ideally suited for use in a closed-cycle torpedo.

I claim:

1. A steam turbine system comprising:

a rotatable turbine wheel;

an annular heat exchanger radially outwardly of said wheel and having a first fluid path including an annular outlet and an inlet in fluid communication with said turbine wheel to receive exhaust steam therefrom and a second fluid flow path in heat exchange relation with said first path, said second path being adapted to receive feed water for the steam turbine; and means for generating an annular, liquid spray across said first flow path at said outlet to remove heat from exhaust steam emerging from said outlet of said first fluid flow path.

2. The steam turbine system of claim 1 wherein said inlet is on the radially inner side of said heat exchanger and said outlet is on the radially outer side of said heat exchanger; and further including means defining a condenser radially outwardly of said outlet and in fluid communication therewith.

3. The steam turbine system of claim 2 wherein said spray generating means is at the interface of said outlet and said condenser.

4. The steam turbine system of claim 1 wherein said first flow path is radially directed, said turbine wheel is an axial flow turbine wheel and said inlet includes a flow director for receiving axially flowing exhaust steam from said turbine wheel and for redirecting the exhaust steam radially to said first flow path.

5. The steam turbine system of claim 1 wherein said first flow path is defined by axially spaced, generally radially directed walls each terminating in an annular conduit and said spray generating means comprise nozzles on said conduits, each nozzle being directed at the opposite conduit.

6. The steam turbine system of claim 1 further including radially outwardly opening grooves on said walls adjacent said conduits, and seals in said grooves, said seals being adapted to seal said outlet to a hull condenser in a closed cycle torpedo or the like.

7. A closed cycle steam turbine system including the steam turbine system of claim 1 and further including a condenser connected to said outlet and a boiler interposed between said condenser and said turbine wheel; and a pump for pumping water from said condenser to said heat exchanger second path and to said spray generating means.

* * * * *